US010196119B2

(12) United States Patent
Gohstand

(10) Patent No.: US 10,196,119 B2
(45) Date of Patent: Feb. 5, 2019

(54) SAIL PRINTING PROCESS

(71) Applicant: Daniel Gohstand, San Francisco, CA (US)

(72) Inventor: Daniel Gohstand, San Francisco, CA (US)

( * ) Notice: Subject to any disclaimer, the term of this patent is extended or adjusted under 35 U.S.C. 154(b) by 741 days.

(21) Appl. No.: 14/828,500

(22) Filed: Aug. 17, 2015

(65) Prior Publication Data

US 2016/0046359 A1 Feb. 18, 2016

Related U.S. Application Data

(60) Provisional application No. 62/038,055, filed on Aug. 15, 2014.

(51) Int. Cl.

| | |
|---|---|
| ***B63H 9/04*** | (2006.01) |
| ***B63H 9/06*** | (2006.01) |
| ***G09F 21/18*** | (2006.01) |
| ***B41M 3/00*** | (2006.01) |
| ***B41M 5/00*** | (2006.01) |
| ***D06P 5/28*** | (2006.01) |

(52) U.S. Cl.

CPC ..... *B63H 9/0657* (2013.01); *B41M 3/00* (2013.01); *B41M 5/0047* (2013.01); *D06P 5/005* (2013.01); *G09F 21/18* (2013.01)

(58) Field of Classification Search

CPC ..... B63H 9/04; B63H 35/00; B32B 27/12; B32B 5/26; B63B 15/0083

USPC ..... 114/102.22–102.33, 103; 428/108–113

See application file for complete search history.

(56) References Cited

U.S. PATENT DOCUMENTS 4,444,822 A * 4/1984 Doyle ..... B32B 27/12 428/109
5,061,553 A * 10/1991 Olsen, Jr. ..... B32B 27/08 114/102.31
5,147,714 A * 9/1992 Ellison ..... D03D 15/0005 428/408
5,333,568 A * 8/1994 Meldner ..... B29C 70/44 114/102.31
6,624,098 B1 * 9/2003 Mahr ..... B32B 5/26 114/102.29
6,886,483 B2 * 5/2005 Kiss ..... B63H 9/0657 114/102.22

(Continued)

*Primary Examiner* — Calvin Lee

(74) *Attorney, Agent, or Firm* — Michael L. Greenberg, Esq.; Greenberg & Lieberman, LLC

(57) ABSTRACT

A process of printing an image or images on the sails of a watercraft or other wind powered vessel without altering or compromising the efficacy of the sails is described. The process employs a method of printing large-scale, single or multiple panel, continuous, high-resolution photographic and graphic images on sails. The dynamics and curvatures of a sail are integrated into manufacturing process when employed for sails, though the process may be applied to any large-scaled fabric print. The process of the present invention produces printed sails providing for the highest resolution photographic, art, and graphic printing with virtually no weight gain, nor effect on the sail's original performance. Modern equipment is employed to achieve printing of realistic, high quality images directly on to the fabric of sails without compromising flexibility or durability, as well as without infringing on the speed and agility of the sailing craft.

2 Claims, 5 Drawing Sheets

(56) References Cited

U.S. PATENT DOCUMENTS

2011/0214595 A1* 9/2011 Kiss ..... B29C 65/52
114/102.31

* cited by examiner

SAIL PRINTING PROCESS

CONTINUITY

This application is a non-provisional application of provisional patent application No. 62/038,055, filed on Aug. 15, 2014, and priority is claimed thereto.

FIELD OF THE PRESENT INVENTION

The present invention relates generally to sailboat sails, and more specifically to the customization of a sailboat's sails such as to include vivid imagery printed on, and embedded within, the fiber of the sail, wherein the sail is visually modified without altering or compromising the inherent qualities of the sail. The process is envisioned for use on a variety of sails including sailboat sails, kitesurfing sails, windsurfing/sailboarding sails, other sails, parachutes, canopies, hang gliders, kites, hot air balloons, or any wind collecting apparatus of a vessel.

BACKGROUND OF THE PRESENT INVENTION

While a variety of boats have been crafted to successfully navigate the water, the ubiquitous sailboat remains ever-present and useful to this day as they were when they were first crafted many years ago. As such, it is common to see sailboats in oceans and waterways the world over, sailing along side motorboats, jet skis, and cruise liners. In some parts of the world, such as Annapolis, Md., USA, the sailing capital of the world, sailing shows and races are a prevalent cultural phenomenon that is celebrated each year. In other parts of the world, recreational sailing is becoming more popular, leading to an increased demand for sailboats, as well as customization options for sailboats to help distinguish a specific owner's boat from the crowd.

In the past, sailors could paint their sails, but this can affect performance and flexibility of the sail, and is not prudent in a competitive atmosphere. Some sails are equipped with a mesh overlay that, when combined with the backdrop of the sail, form an image, however this often results in poor image definition. Sewn-on patches, adhesive vinyl, and laminates are options for visually modifying a sail, but they conventionally damage the sail, add weight, effectively changing the characteristics and performance of the sail. Additionally, these are often limited to lettering only of a few colors.

While it is presently possible to print an image directly onto a sail, the process requires use of a special, laminate-like material as a sail. In order to have an image printed onto a functioning sail presently, a customer must purchase a whole new sail constructed of this specialized material which is prohibitive in cost. Additionally, this laminate-like material is not as effective as conventional sails constructed out of conventional materials, such as those designed to efficiently propel the sailboat or other sail-powered craft. As such, these sails are rarely employed outside of an advertising context.

Thus, there is a need for a process and system to print images onto sails of water craft, as well as to wind-powered aircraft, that is capable of printing on sea-worthy sails of sailboats, rather than requiring customers to employ sub-standard, relatively ineffective laminate sail for the sailboat in order to have a custom image inlaid or printed on the sails. Such a process would preferably be able to print directly onto the originally manufactured sail, composed of conventional sail materials, without the need for new materials or a mesh image screen.

U.S. Pat. No. 6,886,483, granted to Aaron Kiss on May 3, 2005 is for a 'sail and manufacture thereof' including image printing process titled PhotoSails. PhotoSails necessitates a heavy, expensive, and clumsy laminate sail, which is not utilized by the general industry because its use requires great compromises in terms of weight and performance, as well as being cost prohibitive. It is conventionally exclusively relegated to advertising, often employing glossy images on display to the show lines of events, where performance compromise in elements such as speed or agility are not issues. The manufacturing process taught by Kiss requires the customer to purchase an entirely new sail for his or her water craft that not as effective as industry standard sail manufacturing materials and mediums. In effect, the laminate material employed to fabricate and display the images taught by Kiss is not considered to be an authentic, usable sail. PhotoSails were not designed for effective or competitive sailing, and were primarily used for advertising in calm water.

SUMMARY OF THE PRESENT INVENTION

The present invention is a method and process for printing images on a variety of sails including sailboat sails, kitesurfing sails, windsurfing/sailboarding sails, other sails, parachutes and canopies, hang gliders, kites, hot air balloons, etc.—that is, the sail or wind collecting apparatus of any vessel. Via the process of the present invention, sails are printed with photographic, personalized, and artistic images for the display of art and advertising, utilizing a proprietary printing process of printing and construction.

Other customized image based sails printing procedures require the customer to purchase an entirely new sail that is compatible with their printing procedure. Unlike these processes, the process of the present invention allows the use of currently-existing sails, such as custom or original sails, retaining the sail's properties, which include, but are not limited to customized sizing, weight, wear, custom eyelet spacing, numbering, brand, and other similar elements. It is unnecessary to construct an alternate type of sail, which compromises the sail's properties, efficiency, and performance when employed. The method of the present invention is configured to make image printed sails available at a relatively accessible cost, so that they may reach a broader, mainstream audience.

The uniqueness of the presentation further brings an entirely new outlet for marketing, namely presenting opportunities to fly the completed sails printed via the process of the present invention at events and in view of shores and populated areas, at a fraction of billboards or airplanes, and more ecologically friendly than airplanes. Though many things may be printed, the photographic images crafted to be printed via the process of the present invention bring art to an industry (the sailing industry) which has not utilized it as of yet. The scale, impact, and depth of the imagery printed via the process of the present invention creates an overwhelming artistic and spiritual experience, which combines with the movement of the sail and vehicle, and interacts with the wind and natural environment, to create an impact and personal experience not yet touched upon within the sailing community.

It is envisioned that the sails printed on via the process of the present invention include sails or the wind collecting apparatus used on any type of vessel, including sailboats, kitesurfers, windsurfers/sailboards, parachutes, kites, canopies, hot air balloons, hang gliders, etc. On sailboats, any type of sail may be used, encompassing both mainsails and headsails, including but not limited to, mainsails, staysails, jibs, genoas, spinnakers, gennakers, and storm sails.

It is likely that the reasons the process of the present invention has not been employed previously are:

Recent advances in large-scale printing technology have recently facilitated the prospect.

Advances in fabrics have recently been created.

An inability by the close-knit, conservative and conventional sailing industry to see sails as an opportunity for visual impact, and to bring art and individuality to the situation.

DETAILED DESCRIPTION OF THE PREFERRED EMBODIMENT

The present invention is a method and process for directly printing to sails, namely, sails for sailboats, and the wind collecting apparatus of other wind-powered vessels, including but not limited to kitesurfing sails, windsurfing/sailboarding sails, other sails, parachutes, kites, canopies, hot air balloons, and hang gliders, which are printed with photographs and other imagery.

Figure 1:
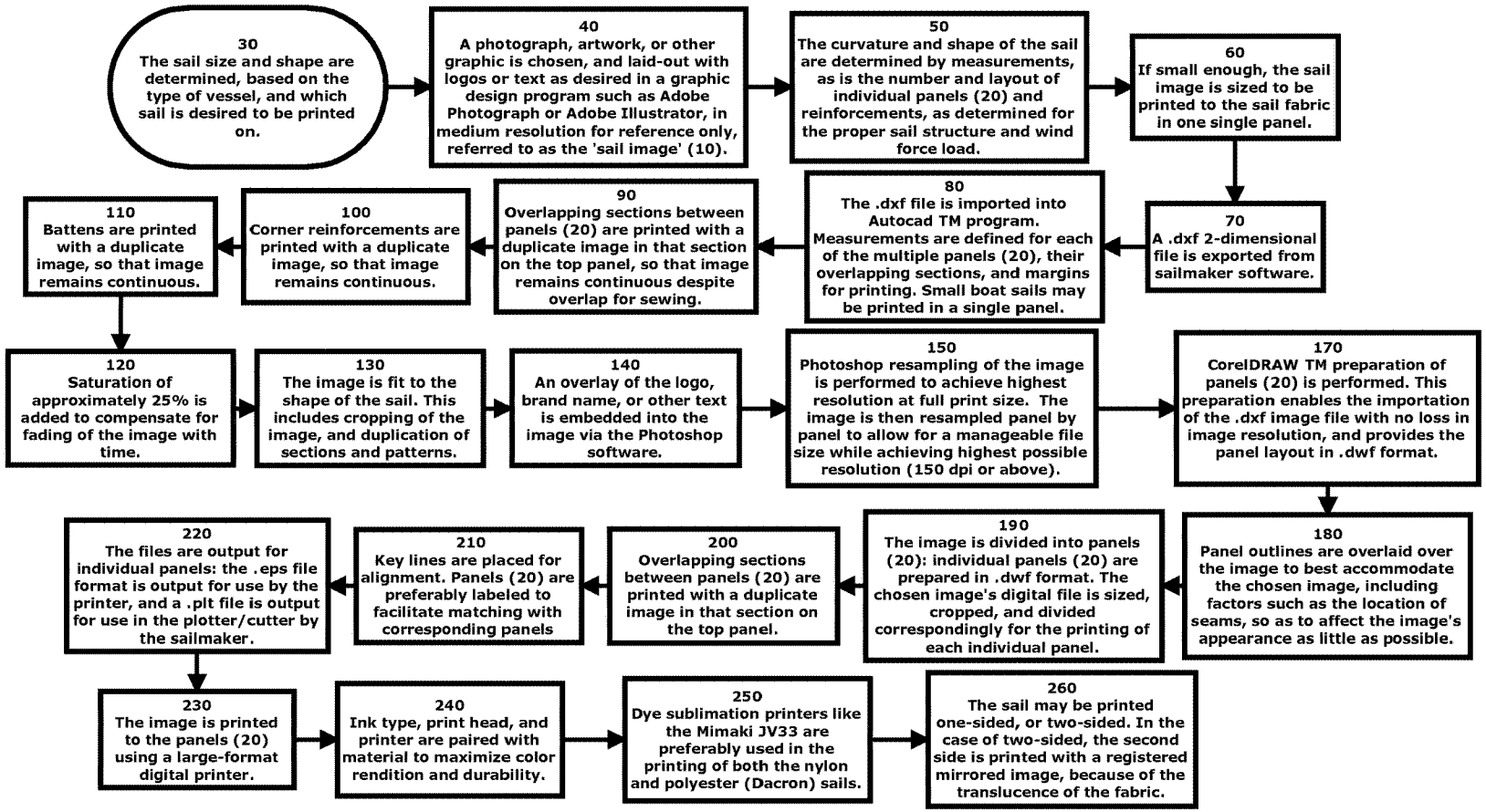
FIG. 1 shows a flow chart of the printing process of the present invention.
Figure 2:
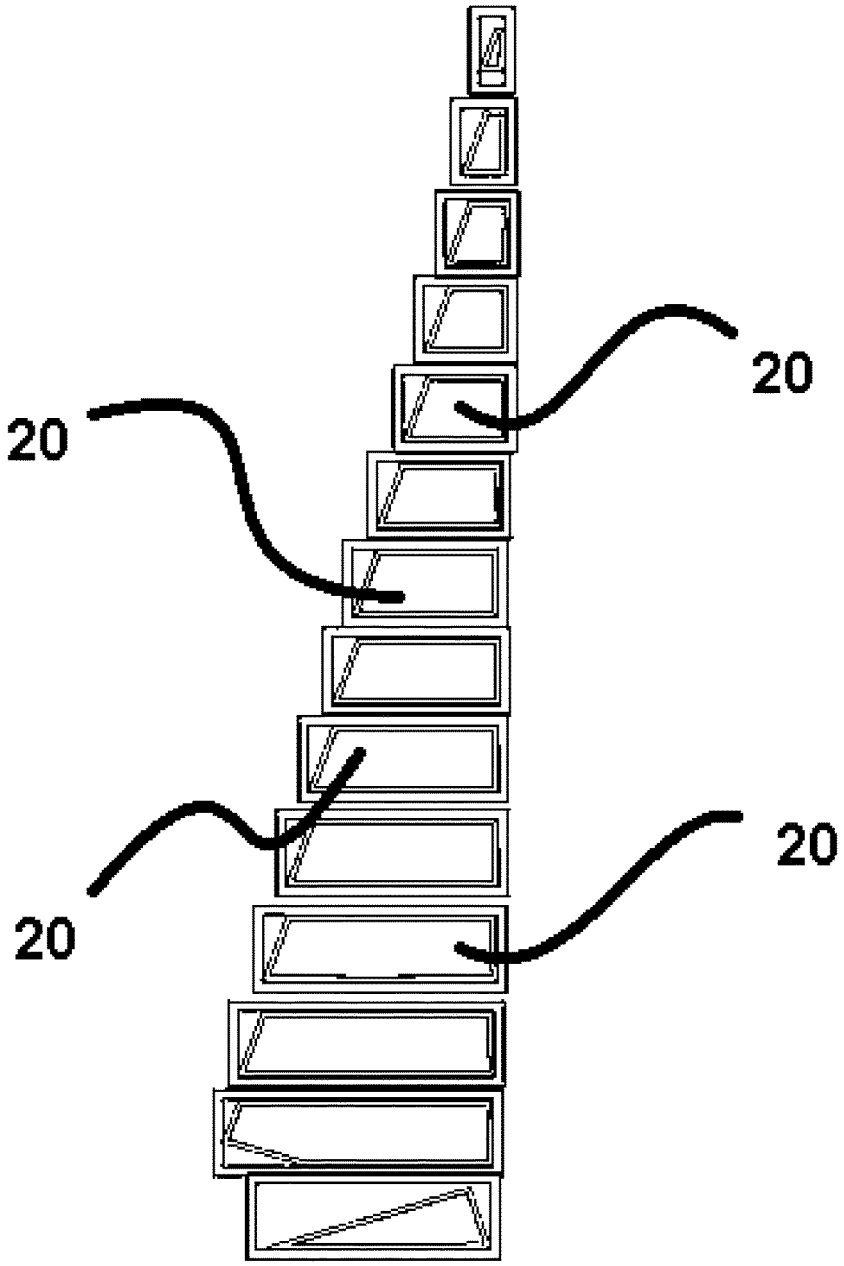
FIG. 2 details a sail-shaped overlay employed during the image preparation process of the method of the present invention, denoting the separation of the image into panels if needed.
Figure 3:
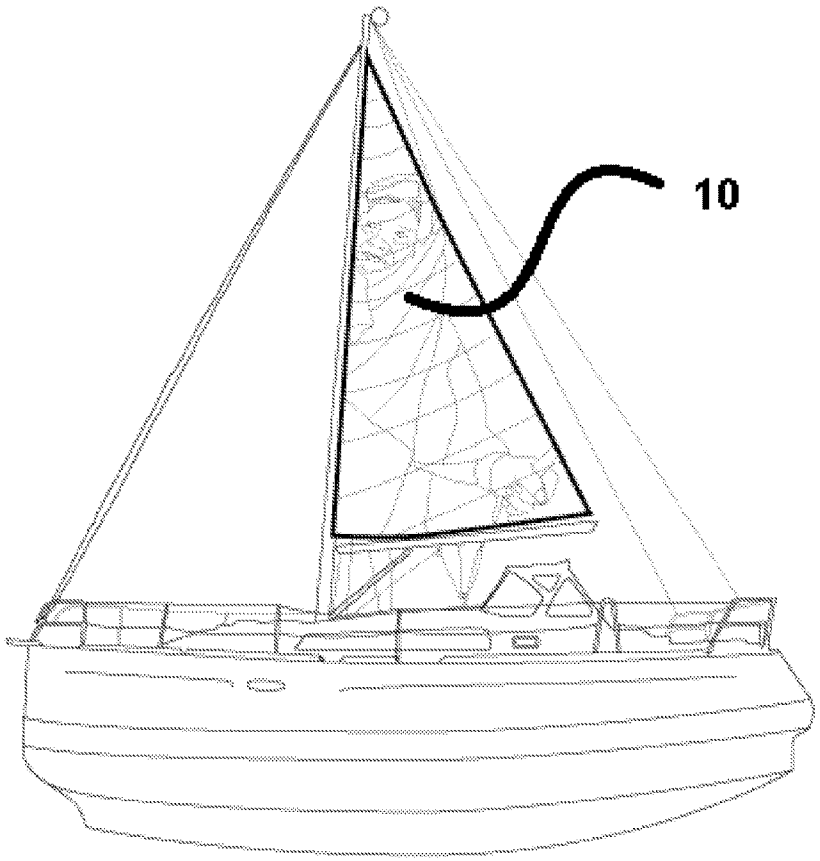
FIG. 3 exhibits a drawing of a sail for a sailboat affixed to the sailboat, equipped with the printing accomplished via the process of the present invention.
Figure 4:
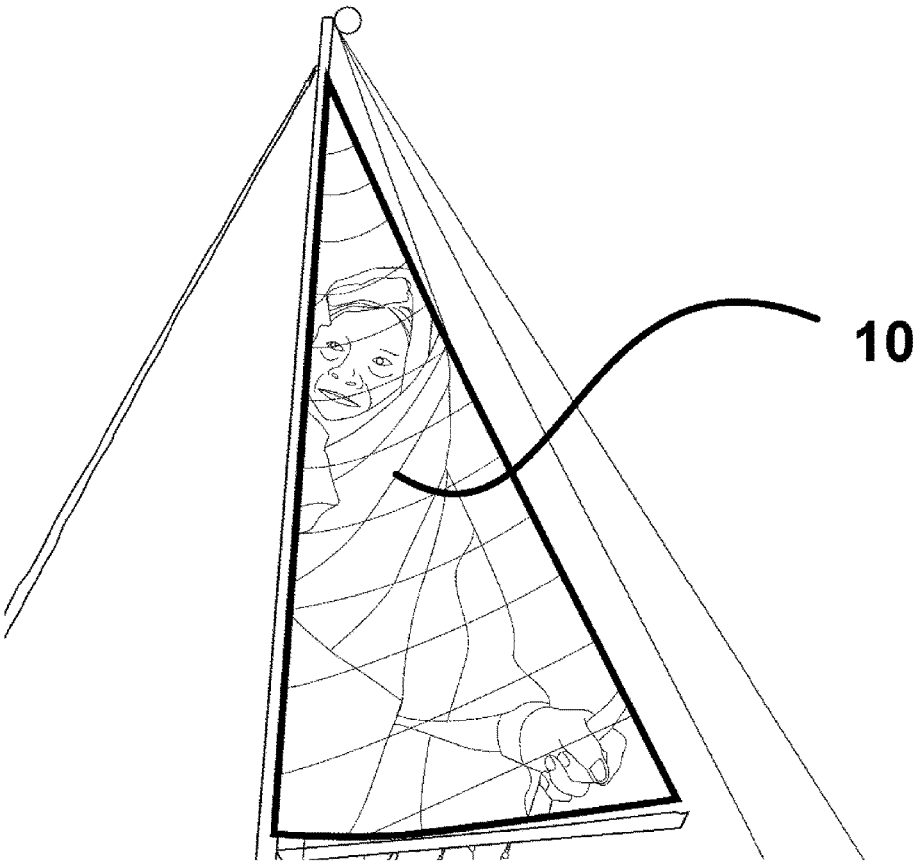
FIG. 4 shows a closer view of the sail printed via the process of the present invention, attached in the extended orientation on a sailboat.
Figure 5:
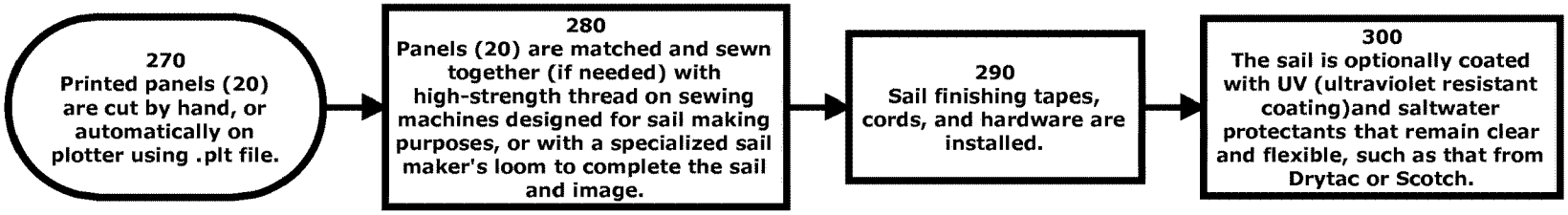
FIG. 5 details a flow chart depicting the steps of sail assembly by the sailmaker after printing to the sails via the process of the present invention.

The method and process of the present invention includes four primary components detailed below: Digital preparation of the image for the specific size and shape of the sail, fabric identification, sail image printing directly to sail fabric, and assembly by the sailmaker. The process of the present invention is generally described as follows, as seen in FIG. 1:

I) Digital Preparation

1) First, the sail size and shape are determined, based on the type of vessel, and which sail is desired to be printed on. (30)

2) A photograph, artwork, or other graphic is chosen, and laid-out with logos or text as desired in a graphic design program such as Adobe™ Photoshop™ or Adobe™ Illustrator™, in medium resolution for reference only, referred to as the 'sail image' (10). (40) The photographs and art employed may be Daniel Gohstand's own copyrighted work as a professional photographer, or other photographs, art, logos, advertising, or other image-based visuals.

3) Sail image and layering is custom designed by the sailmaker enacting the process of the present invention, utilizing specialty sailmaker software. The curvature and shape of the sail are determined by measurements, as is the number and layout of individual panels (20) and reinforcements, as determined for the proper sail structure and wind force load. (50)

4) If small enough, the sail image is sized to be printed to the sail fabric in one single panel. (60)

5) A .dwf 2-dimensional file is exported from sailmaker software. (70)

6) The .dwf file is imported into Autocad™ program. Measurements are defined for each of the multiple panels (20), their overlapping sections, and margins for printing. Small boat sails may be printed in a single panel. (80)

7) Adobe™ Photoshop™ (or other similar image editing software) is employed to manipulate the image if necessary. Image must be high resolution, preferably RAW or .psd file for the best results.

A) Overlapping sections between panels (20) are printed with a duplicate image in that section on the top panel, so that image remains continuous despite overlap for sewing. (90)

B) Corner reinforcements are printed with a duplicate image, so that image remains continuous. (100)

C) Battens are printed with a duplicate image, so that image remains continuous. (110)

D) Saturation of approximately 25% is added to compensate for fading of the image with time. (120)

E) The image is fit to the shape of the sail. This includes cropping of the image, and duplication of sections and patterns. (130)

8) An overlay of the logo, brand name, or other text is embedded into the image via the Photoshop™ software. (140)

9) Photoshop™ resampling of the image is performed to achieve highest resolution at full print size. The image is then resampled panel by panel to allow for a manageable file size while achieving highest possible resolution (150 dpi or above). (150)

10) CorelDRAW™ preparation of panels (20) is performed. This preparation enables the importation of the .dxf image file with no loss in image resolution, and provides the panel layout in .dwf format. (170)

A) Panel outlines are overlaid over the image to best accommodate the chosen image, including factors such as the location of seams, so as to affect the image's appearance as little as possible. (180)

B) The image is divided into panels (20): individual panels (20) are prepared in .dwf format. The chosen image's digital file is sized, cropped, and divided correspondingly for the printing of each individual panel. (190) Appearance of the chosen image is maximized.

C) Overlapping sections between panels (20) are printed with a duplicate image in that section on the top panel. (200) This is performed so that the image (when printed) remains continuous despite overlap for sewing. Key lines are placed for alignment. Panels (20) are preferably labeled to facilitate matching with corresponding panels (20). (210)

D) Finally, the files are output for individual panels (20): the .eps file format is output for use by the printer, and a .plt file is output for use in the plotter/cutter by the sailmaker. (220)

11) Panels (20) are preferably nested for the printer to minimize fabric waste.

II) Fabrics—Printing Optimization Based on Sail Fabric Medium

1) Main sails, jibs, and genoas are constructed with sail polyester (Dacron), which is pre-impregnated or pre-coated with resin which helps the application of the ink, and the durability of the material. With its high durability coupled with relatively low cost, Dacron is the main material employed for cruising boats and advertisers.

2) Spinnakers are constructed with sail nylon, which is pre-impregnated or pre-coated with resin, which facilitates the application of the ink during printing to the sail, and the durability of the material.

3) The majority of aircraft sails and skins are constructed with nylon, which is pre-impregnated or pre-coated with resin, which facilitates the application of the ink to the sail (hang glider sail, kite, hot air balloon, etc.), and helps ensure the durability of the material.

4) Specialty and high-tech Kevlar and other materials are printed on using appropriate printers and inks III) Printing 1) The image is printed to the panels (20) using a large-format digital printer. (230)

2) A flatbed printer may be used for smaller sails that do not require lengthy panels, especially for registration of 2-sided mirrored printing of smaller sails.

3) A roll printer is used for lengthy panels (20) for large sails.

4) Ink type, print head, and printer are paired with material to maximize color rendition and durability. (240) All printers' inks are designed to increase lifespan and provides resistance from sun, salt, and fresh water.

5) Dye sublimation printers like the Mimaki JV33 are preferably used in the printing of both the nylon and polyester (Dacron) sails. (250) Dye sublimation is effective as ink is infused into the fibers of the substrate itself, as opposed to a pigmented ink that builds up on the fabric. This level of saturation produces superior output. Another important benefit of the ink being infused directly into the fabric is that without any additional surface protection, the image is permanent and cannot be washed away, rubbed off or otherwise removed from the fabric, thereby increasing the longevity in the demanding conditions encountered in sailing and flying. These inks are also more eco-friendly than most inks employed in printing.

Because the melting point of nylon is approximately 428° F., depending on the type, and of polyester (Dacron) 482° F., the heating drum employed by the dye sublimation heat transfer process maintains a temperature low enough that it does melt these fabrics, at about 400° F.

6) The sail may be printed one-sided, or two-sided. In the case of two-sided, the second side may be printed with a registered mirrored image, because of the translucence of the fabric. (260) Flatbed digital printers are preferably used for the double-sided printing of smaller sails, as they benefit from easier registration of the two sides to achieve a mirrored image on the second side which is precisely aligned with the print on the first side. Because of limitations of the length of the bed, this is usually limited to sails wherein the longest panel is shorter than ten feet.

7) It is envisioned that alternate printers, or printers effectively capable of the features of these printers, may be employed in lieu of the listed printers, such as the Hewlett-Packard HP360 latex printer, or EFI Vutek UV printer for polyester (Dacron), and the Hewlett-Packard FB700, Hewlett-Packard HP360 latex printer, or EFI Vutek UV printer for nylon.

8) If text is desired on both sides of a two-sided sail, a white ink base layer is applied under the text on one side as a blocking agent, because of the translucence of the fabric.

9) The process of the present invention is configured to not alter the essential characteristics of the sail greatly, neither in terms of weight or performance, thereby retaining the sail's natural advantages, and doing away with the necessity, until now, of altering and constructing a sail based on the desire to print an image on it.

The printing process employed via the process of the present invention is specific to the application, and is unique in its capacity to print on a variety of mediums and weights. The specialty inks increase lifespan, and resistance to sun and salt and fresh water. An ultraviolet coating may be applied or incorporated in the ink, to increase the sail and image's lifespan.

10) The listed printers have a five-meter wide accommodation, facilitating large-scale printing. However, most cloths required for use via the process of the present invention are available in a 60 inch maximum width. Taking advantage of these application technologies, the sail's image affixes better when applied via the process of the present invention than with other methods, and has greeter lasting qualities, affording greater resistance to wear, stress caused by winds, and resistance to sun and salt and fresh water.

IV) Sail Assembly by Sailmaker

1) Printed panels (20) are cut by hand, or automatically on plotter using .plt file. (270)

2) Panels (20) are matched and sewn together (if needed) with high-strength thread on sewing machines designed for sail making purposes, or with a specialized sail maker's loom to complete the sail and image. (280) The sail maker's loom is specially designed for large scale industrial sewing projects. The loom includes a long stationary sewing table with a traveling, self propelled sewing machine head, affording the straightest seams possible. The sail maker's loom is preferably expandable to any length necessary for a project, regardless of its size or shape.

3) Sail is further shaped by sailmaker

4) Sail finishing tapes, cords, and hardware are installed. (290)

5) The sail is optionally coated with UV (ultraviolet resistant coating) and saltwater protectants that remain clear and flexible, such as that from Drytac or Scotch. (300) The UV coating increases the lifespan of the sail and image.

V) Furling Systems Recommended for Longevity

1) A boom furling system, or in-mast furling system, is recommended to preserve the sail's lifespan.

The printing process employed via the process of the present invention is specific to the application, and is unique in its capacity to print on a variety of mediums and weights. The printer's UV resistant inks increase lifespan, and resistance to sun and salt and fresh water. An ultraviolet coating may be applied or incorporated in the ink, to increase the sail and image's lifespan.

The printer's five-meter wide accommodation makes large-scale printing accessible. However, most cloths required for use via the process of the present invention are available in a 60 inch maximum width. Taking advantage of these application technologies, the sail's image affixes better when applied via the process of the present invention than with other methods, and has greeter lasting qualities, affording greater resistance to wear, stress caused by winds, and resistance to sun and salt and fresh water.

It is envisioned that any type and weight of sail material may be employed to be printed on via the process of the present invention, including but not limited to polyesters including Polyethylene terephthalate (Dacron), and Polyethylene naphthalate (Pentex), as well as nylon, Kevlar, Technora, Twaron, Spectra, Dyneema, Certran, (PBO) Zylon, Vectran, carbon fiber, and developing fibers. The process of the present invention may also be employed with films, including but not limited to Biaxially-oriented polyethylene terephthalate (Mylar, Melinex and Hostaphan), and Polyethylene naphthalate film. It is envisioned that laminates may also be used upon request.

It is envisioned that the photographs and art employed may be Daniel Gohstand's own copyrighted work, as a professional photographer, or other photographs or art, including but not limited to the boat's name, the boat owner's name, portraits, family portraits, family crests, ocean or other scenes, logos, insignias, colors, designs, etc. Ultraviolet resistant chemical elements and coatings may be employed to increase lifespan of the ink, and resistance of erosion of the ink to sun, salt and fresh water.

It should be understood that uses for the process of the present invention include, but are not limited to, advertising, marketing, branding, announcements, art, and visual enjoyment and enhancement, or other applications.

It should be understood that for these purposes of this application, the terms "sailboat" or "sailboats" includes monohulls and multihulls (catamarans/trimarans), and other types of vessels utilizing sails.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A method for permanently printing an image to a durable wind-catching fabric comprising:

identifying the size and shape of the wind-catching fabric;
selecting an image to print to the wind-catching fabric;
using image editing software to size the image to the proportions of the wind-catching fabric;
using image editing software to divide the image into panels for printing;
maximizing the resolution of the image to at least 150 dots per inch (DPI);
saturating the image by 25 percent;
embedding one of the following into the image: a logo, a brand name, text;
exporting a two-dimensional copy of the image to a Cad program;
defining the size of the panels to include overlapping sections and margins for printing;
preparing the panels individually on the cad program for alignment to the wind-catching fabric;
placing key lines on the image;
labeling the panels consecutively;
saving the panels as individual digital image files;
exporting the panels saved as individual digital image files to the printer;
printing the image of the individual digital image files to the wind-catching fabric using a large format digital printer via dye sublimation, forming printed panels;
printing corner reinforcements with a duplicate image;
printing battens with a duplicate image;
cutting the printed panels with a plotter;
sewing the panels together with a sailmaker's loom; and
coating the panels with an ultraviolet resistant coating.

2. A method for printing high-resolution images to sails without compromising the performance of the sail comprising:

identifying the size and shape of the sail;
selecting an image to print to the sail;
using image editing software to size the image to the proportions of the sail;
using image editing software to divide the image into panels for printing;
maximizing the resolution of the image to at least 150 dots per inch (DPI);
exporting a two-dimensional copy of the image to a Cad program;
defining the size of the panels to include overlapping sections and margins for printing;
preparing the panels individually on the cad program for alignment to the sail;
placing key lines on the image;
labeling the panels consecutively;
saturating the image by 25 percent;
saving the panels as individual digital image files;
exporting the panels saved as individual digital image files to the printer;
printing the image of the individual digital image files to the sail using a large format digital printer, forming printed panels, wherein printing is performed by dye sublimation;
cutting the printed panels with a plotter;
sewing the panels together with a sailmaker's loom; and
coating the panels with an ultraviolet resistant coating.

* * * * *